US009959789B2

(12) United States Patent
Sato

(10) Patent No.: US 9,959,789 B2
(45) Date of Patent: May 1, 2018

(54) METHOD AND APPARATUS FOR APPLYING A LABEL OR LAMINATE SHEET TO A SUBSTRATE

(71) Applicant: CCL Label, Inc., Framingham, MA (US)

(72) Inventor: Jay K. Sato, Mission Viejo, CA (US)

(73) Assignee: CCL LABEL, INC., Framingham, MA (US)

( * ) Notice: Subject to any disclaimer, the term of this patent is extended or adjusted under 35 U.S.C. 154(b) by 0 days. days.

(21) Appl. No.: 14/971,144

(22) Filed: Dec. 16, 2015

(65) Prior Publication Data

US 2016/0180749 A1 Jun. 23, 2016

Related U.S. Application Data

(60) Provisional application No. 62/092,306, filed on Dec. 16, 2014.

(51) Int. Cl.
*G09F 3/10* (2006.01)
*G09F 3/02* (2006.01)

(52) U.S. Cl.
CPC ..... *G09F 3/10* (2013.01); *G09F 3/02* (2013.01); *G09F 2003/0255* (2013.01)

(58) Field of Classification Search
CPC ... G09F 3/02; G09F 2003/0255; Y10T 428/14
See application file for complete search history.

(56) References Cited

U.S. PATENT DOCUMENTS 3,535,804 A 10/1970 Cunningham
4,537,809 A * 8/1985 Ang ..... B29C 59/007 156/250
5,182,152 A * 1/1993 Ericson ..... B42F 21/00 283/101
6,479,118 B1 * 11/2002 Atkinson ..... B65C 9/265 283/81
8,273,436 B2 * 9/2012 Flynn ..... B32B 7/12 40/638
2006/0037507 A1 * 2/2006 Trigg ..... G09F 3/0288 101/483
2010/0129583 A1 * 5/2010 Hong ..... G09F 3/0288 428/41.8

* cited by examiner

*Primary Examiner* — Patricia L. Nordmeyer
(74) *Attorney, Agent, or Firm* — McDonald Hopkins, LLC

(57) ABSTRACT

A sheet assembly and method is provided for applying a facestock layer to a substrate. The facestock layer may include a facestock bridge portion with an adhesive layer. A liner sheet is attached to the facestock layer and may include a strip portion having a first dimension that is configured to be removed to expose a portion of the adhesive layer under the facestock bridge portion. The sheet assembly is positioned as desired and the facestock bridge portion is adhered to the substrate to anchor the sheet assembly to the substrate and allow the remaining liner sheet to be removed in a generally aligned manner as desired. The facestock layer may be made of a see-through material. The facestock layer may be a label. The sheet assembly may include at least one perforation line that divides the sheet assembly into multiple sections.

21 Claims, 8 Drawing Sheets

METHOD AND APPARATUS FOR APPLYING A LABEL OR LAMINATE SHEET TO A SUBSTRATE

CROSS-REFERENCE TO RELATED APPLICATIONS

This application claims priority to U.S. provisional patent application No. 62/092,306 filed on Dec. 16, 2014 titled METHOD AND APPARATUS FOR APPLYING A LABEL OR LAMINATE SHEET TO A SUBSTRATE which is incorporated by reference in its entirety.

FIELD OF INVENTION

The present disclosure generally relates to a method and assembly for facilitating easy and professional application of labels and laminates to a substrate. More particularly, the disclosure relates to a label or laminate sheet made of large or flexible material that is configured to be aligned and manually applied to the substrate by a user in an efficient manner.

BACKGROUND

Labels and laminate sheets are well known and various types have been proposed to meet the requirements of a wide variety of label applications. For example, labels are extensively used in retail businesses for communicating product information to customers. Labels generally include a facestock layer with an adhesive side and an exposed side. The exposed side includes label indicia thereon and is opposite from the adhesive side. A liner sheet is operably attached to the adhesive side and is configured to allow a user to peal the label portion of the facestock from the liner sheet to be placed on a substrate. Similarly, a laminate sheet may include a facestock that is a generally transparent plastic material having an adhesive side that is attached to a liner sheet. The facestock is configured to be pealed from the liner such that the adhesive side can be applied to a substrate. This allows the laminate facestock to protect the substrate while allowing users to view the substrate through the laminate.

However, problems arise when a user peals the label or laminate facestock from the liner and attempts to place the facestock on the substrate. Many times the facestock fails to adhere due to inconsistent application by the user. The placing of the adhesive side to the substrate can be a challenge to the user as unwanted bubbles or ridges may be created between the facestock and the substrate. These ridges and bubbles may be unsightly and difficult to properly correct. Inconsistent application becomes more likely when the label or laminate facestock is large relative to the hands of the user and is made from a generally flexible material. The user may have a difficult time handling the facestock while placing the adhesive side against the substrate as intended. Further, the facestock becomes difficult to correctly align with the substrate in certain applications. Additionally, the facestock is difficult to handle because the laminate sheet is very thin and pliable.

Therefore, there is a need for a label or laminate sheet assembly having a facestock and liner material that can be configured to reduce inconsistent application by the user. There is also a need for an improved method of applying a label or laminate sheet to a substrate that reduces the steps necessary to accurately position and consistently apply the label or laminate to the substrate.

Accordingly, one of the primary objects of the present disclosure is to provide a label or laminate sheet assembly having a facestock and liner that is easily utilized by a user for manual application to the substrate. It is another object of the present disclosure to provide methods to remove the liner from the facestock of the assembly for the accurate placement of a label or laminate facestock material on the substrate.

SUMMARY

A label or laminate assembly is provided as shown and described herein. The label or laminate may be a sheet assembly that is configured to apply a facestock layer to a substrate. The facestock layer may include a facestock bridge portion with an adhesive layer. A liner sheet is attached to the facestock layer and may include a strip portion having a first dimension that is configured to be removed to expose a portion of the adhesive layer under the facestock bridge portion. The facestock bridge portion is adhered to the substrate to anchor the sheet assembly to the substrate and allow the remaining liner sheet to be removed in a generally aligned manner as desired. The facestock layer may be made of a generally see-through material. Alternatively, the facestock layer may be a label. Additionally, the sheet assembly may include at least one perforation line that divides the sheet assembly into multiple sections wherein the sheet assembly includes at least one of two sections, four sections, and ten sections. The sheet assembly may include at least one die cut line within the facestock layer for separating a facestock portion and a matrix portion.

In one embodiment provided is a method of applying a facestock layer to a substrate, the method includes the steps of providing a sheet assembly having a facestock layer with a facestock bridge portion, an adhesive layer and a liner sheet with a strip portion having a first dimension. The strip portion of the liner sheet is removed from the facestock layer to expose a portion of adhesive. The sheet assembly is aligned with the substrate in a desired orientation. The facestock bridge portion is anchored to the substrate. The remaining portion of the liner sheet is removed from the facestock layer to expose the adhesive layer to the substrate. The remaining portion of the facestock layer is adhered to the substrate.

BRIEF DESCRIPTION OF THE DRAWINGS

Operation of the disclosure may be better understood by reference to the following detailed description taken in connection with the following illustrations, wherein.

DETAILED DESCRIPTION

Reference will now be made in detail to embodiments of the present disclosure, examples of which are illustrated in the accompanying drawings. It is to be understood that other embodiments may be utilized and structural and functional changes may be made without departing from the respective scope of the disclosure. Moreover, features of the various embodiments may be combined or altered without departing from the scope of the disclosure. As such, the following description is presented by way of illustration only and should not limit in any way the various alternatives and modifications that may be made to the illustrated embodiments and still be within the spirit and scope of the disclosure.

A laminate or label sheet assembly 10 is disclosed and may be of any appropriate configuration and is not limited to that shown and described herein. It should similarly be understood that the sheet assembly 10 may be adapted to any appropriate size, including, without limitation, 8.5 inches by 11 inches, A4 size, legal size or any other size. The sheet assembly 10 may be made of any appropriate materials and colors or indicia and this disclosure is not limited in this regard.

Figure 1:
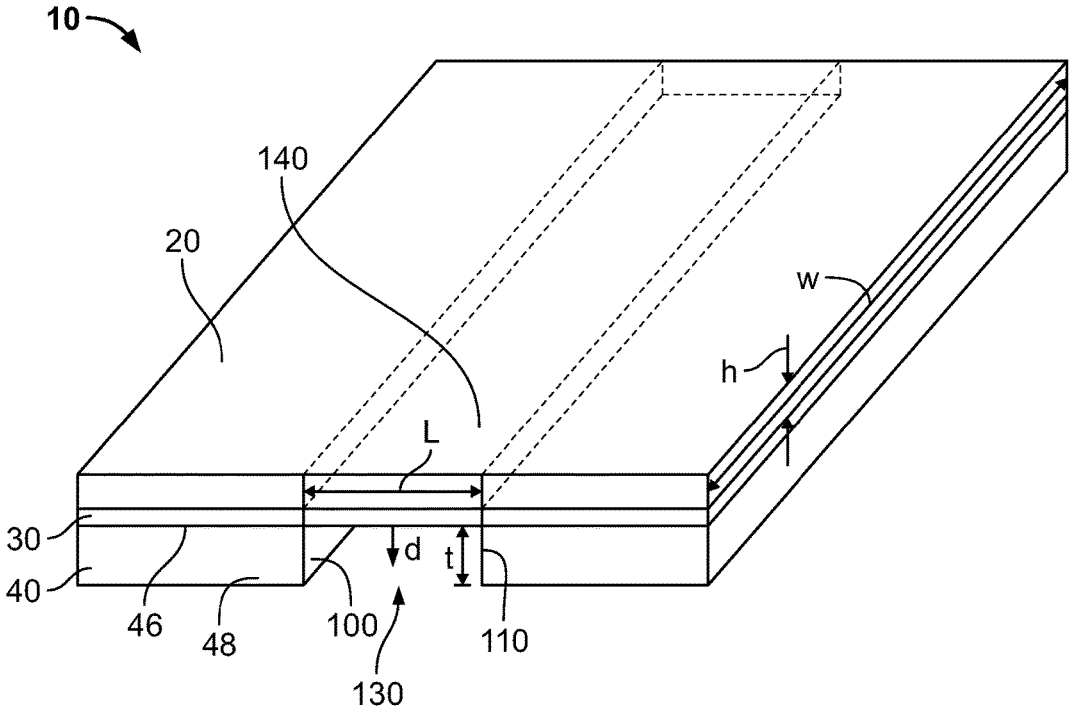
FIG. 1 is a perspective view of an embodiment of a laminate sheet assembly of the present disclosure with the liner sheet strip portion removed.

FIG. 1 is a perspective view of the sheet assembly 10 that may include a facestock layer 20 which may be coated with a pressure sensitive adhesive layer 30. Sheet assembly 10 may also include a liner sheet 40 having a first surface 46 with a release coating for supporting the adhesive layer 30 and a second surface 48 opposite the first surface 46. The liner sheet 40 may be made of any appropriate material, including, without limitation a calendared paper or polymer film. The facestock layer 20 may be of any appropriate material, including without limitation a paper, plastic or polymer material such as a polyester material or other transparent, translucent or semi-translucent or opaque material. The facestock layer 20 may also be a laminate or a label or combination of both.

Figure 2:
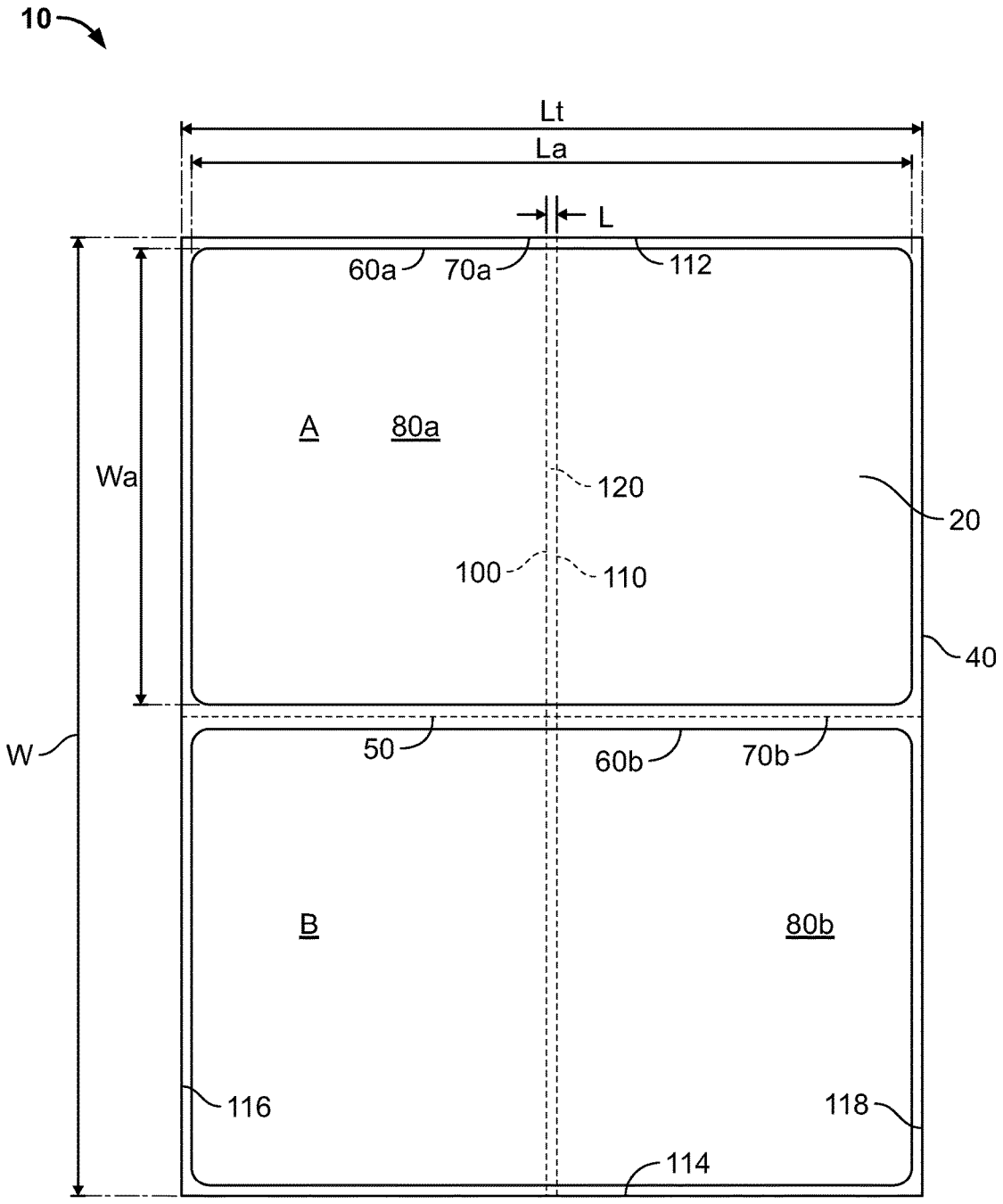
FIG. 2 is a plan view of an embodiment of the laminate sheet of the present disclosure.
Figure 3:
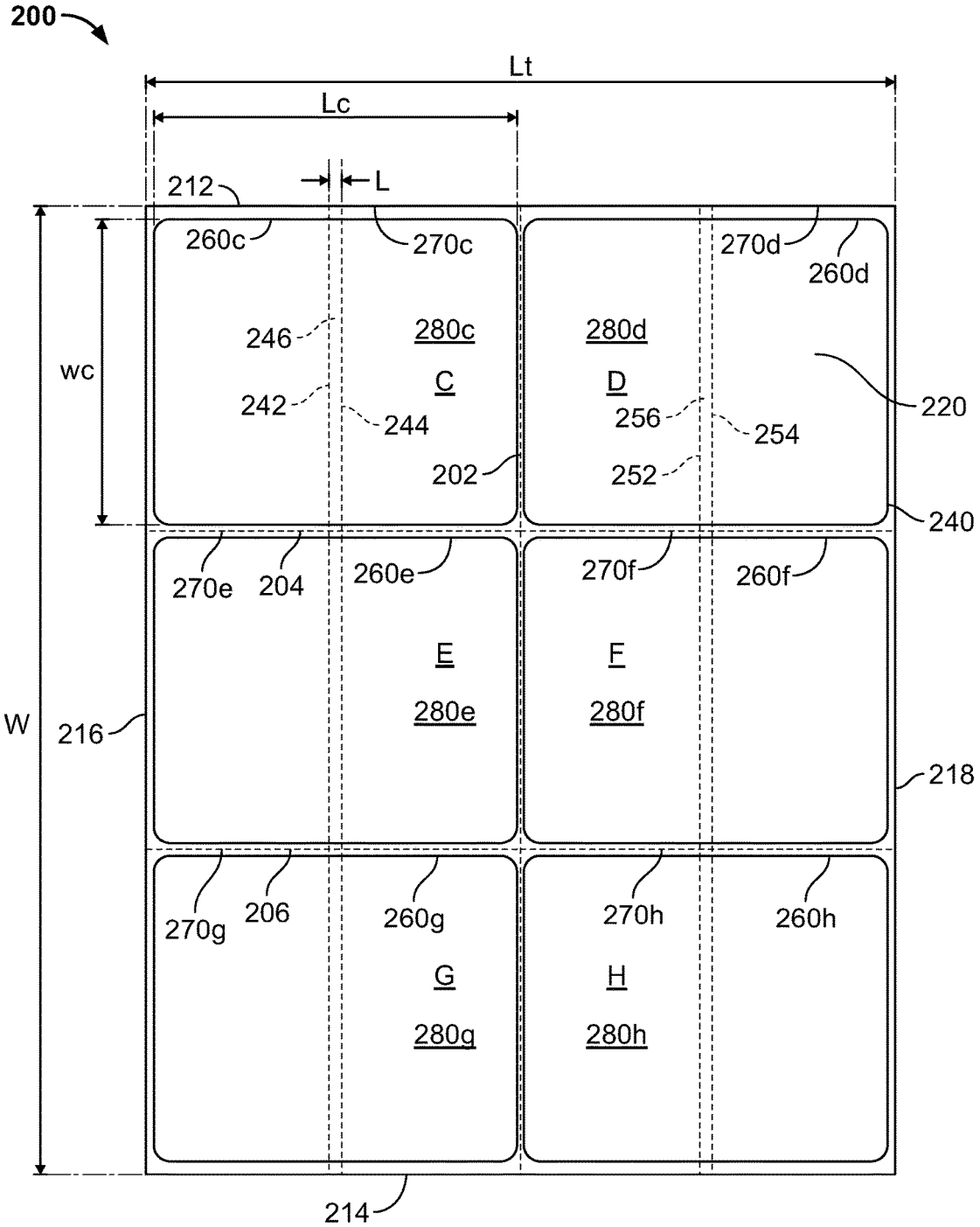
FIG. 3 is a plan view of an embodiment of the laminate sheet in accordance with one aspect of the present disclosure.
Figure 4:
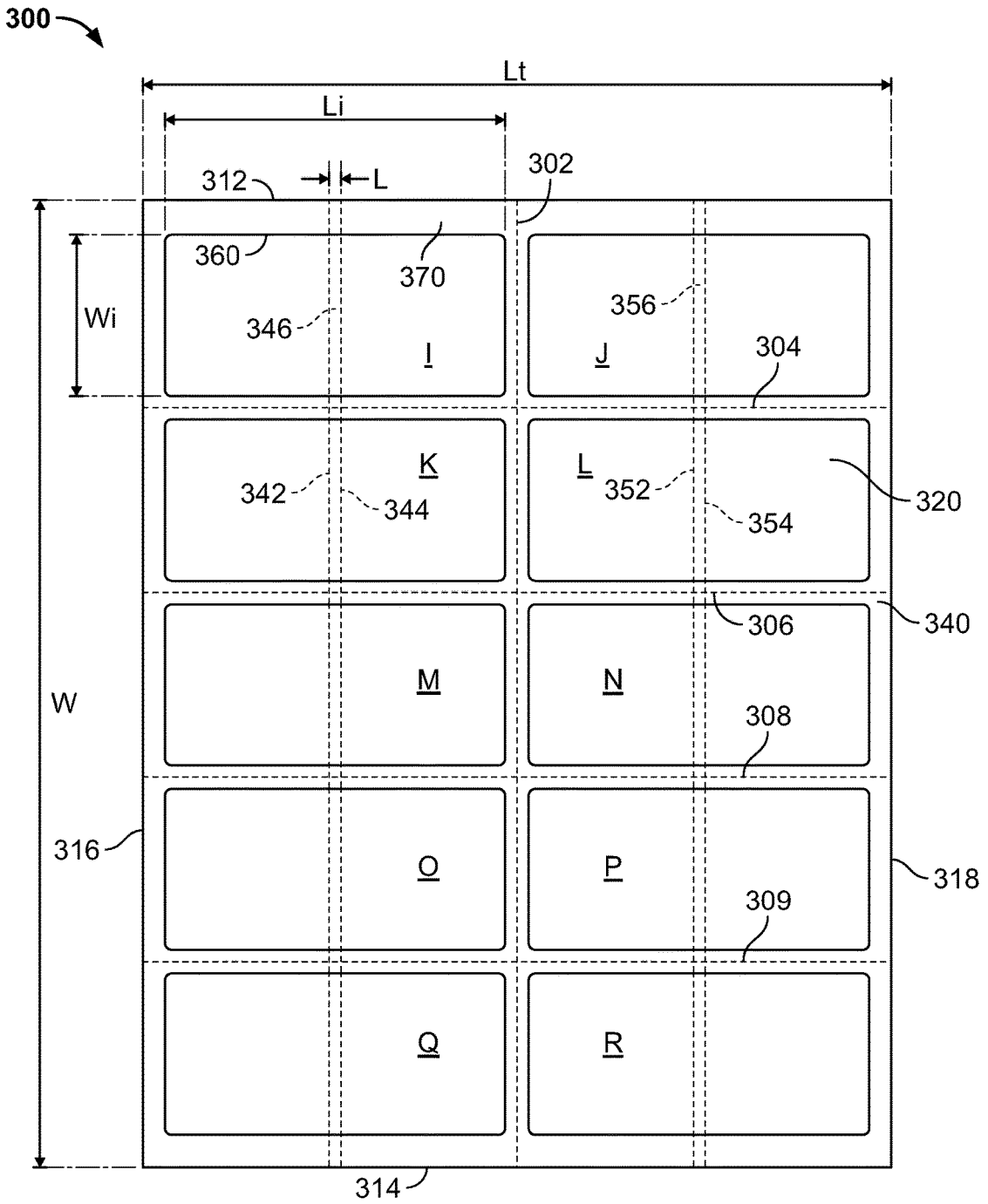
FIG. 4 is a plan view of an embodiment of the laminate sheet in accordance with an embodiment of the present disclosure.

As illustrated by FIGS. 2-4, the top or facestock layer 20 of the sheet assembly 10 is shown in plan view. The sheet assembly 10 may include a plurality of perforations along a perforation line 50 that may extend through the facestock layer 20 and the liner sheet 40 to separate that sheet assembly into predefined sizes. Various embodiments of these particular sizes are illustrated by FIGS. 2-4. FIG. 2 illustrates a sheet assembly 10 having a first section A and a second section B separated by perforation line 50. The first section A includes at least one die cut line 60*a* through the facestock layer 20. The die cut line 60*a* may separate section A between a matrix portion 70*a* and a facestock portion 80*a* wherein the matrix portion 70*a* may be removed from the liner sheet 40 and the facestock portion 80*a*. The second section B includes at least one die cut line 60*b* through the facestock layer 20. The die cut line 60*b* may separate second section B between a matrix portion 70*b* and a facestock portion 80*b* wherein the matrix portion 70*b* may be removed from the liner sheet 40 and the facestock portion 80*b*.

The sheet assembly 10 may also include first and second die cut lines 100, 110 through the liner sheet 40. The first die cut line 100 and the second die cut line 110 may be generally parallel to one another to define a strip portion 120 of the liner sheet 40. The strip portion 120 may include a first dimension or gap L that defines a length wherein the first dimension L is between approximately 0.032 inch to 0.4375 inch, or between about 0.0625 inch to 0.375 inch and is more particularly about 0.125 inch. See Table 1 for examples.

The first and second die cut lines 100, 110 may extend from a first edge 112 to a second edge 114 of the sheet assembly 10. In this embodiment, the die cut lines 100, 110 define the strip portion 120 having a second dimension W wherein the second dimension W is the distance between the first edge 112 and the second edge 114 of the sheet assembly. In addition to the first and second edges 112, 114, a third edge 116 may be opposite a fourth edge 118 that generally define a perimeter of the sheet assembly 10. The space between the third edge 116 and the fourth edge 118 may be defined by a third dimension Lt. The third dimension Lt represents the total length of the sheet assembly 10 and the second dimension W represents the transverse length of the total sheet assembly 10.

In one embodiment, the second dimension W may be between approximately 7 inches and 18 inches, or more narrowly between approximately 11 inches and 14 inches. The third dimension Lt may be between approximately 5 inches and 11 inches, or may be approximately 8.5 inches. Alternately, the second dimension and third dimension of the sheet assembly 10 may include dimensions that compare to standard US paper sizes including letter (8.5×11 in), legal (8.5×14 in), junior legal (5×8 in), and ledger/tabloid (11×17 in) sizes or standard international paper sizes such as A, B, and C paper sizes.

In the embodiment of FIG. 2, first section A and second section B may be formed by the perforation line 50 wherein the first section A may have a generally equal size to the second section B. First section A includes facestock portion 80*a* that includes length portion La and width portion Wa. In one embodiment, the length portion La may be approximately 0.25 inch less than the third dimension Lt such that the difference in dimension is generally defined by the matrix portion 70*a*. In one embodiment, length portion La may be approximately 8.25 inches. The width portion Wa may be approximately 0.25 inch less than ½ of the second dimension W. In one embodiment, width portion Wa may be approximately 5.25 inches. Alternatively, the length portion La and width portion Wa of the facestock portion 80*a* may be generally equal to the third length Lt and ½ of the second length W such that the facestock portion 80*a* is generally the entire first section A. The strip portion 120 may extend under die cut lines 60*a* and 60*b* as well as through perforated line 50 as illustrated by FIG. 2.

FIG. 3 illustrates another embodiment of the instant disclosure wherein a sheet assembly 200 may include a facestock layer 220 with an adhesive layer 230 and liner sheet 240. The sheet assembly 200 may be defined by a first edge 212, a second edge 214, a third edge 216 and a fourth edge 218 that may define a perimeter of the sheet assembly 200. The sheet assembly 200 may include a plurality of sections C, D, E, F, G, and H that are separated by a plurality of perforation lines 202, 204, and 206. Perforation line 202 may extend from the first edge 212 to the opposite second edge 214. Perforation lines 204 and 206 may extend from the third edge 216 to the fourth edge 218 such that perforation line 204 is generally parallel to perforation line 206.

Section C includes at least one die cut line 260*c* through the facestock layer 220. The die cut line 260*c* may separate section C between a matrix portion 270*c* and a facestock portion 280*c* wherein the matrix portion 270*c* may be removed from the liner sheet 240 and the facestock portion 280*c*. Section D includes at least one die cut line 260*d* through the facestock layer 220. The die cut line 260*d* may separate section D between a matrix portion 270*d* and a facestock portion 280*d* wherein the matrix portion 270*d* may be removed from the liner sheet 240 and the facestock portion 280*d*. Section E includes at least one die cut line 260*e* through the facestock layer 220. The die cut line 260*e* may separate section E between a matrix portion 270*e* and a facestock portion 280*e* wherein the matrix portion 270*e* may be removed from the liner sheet 240 and the facestock portion 280*e*. Section F includes at least one die cut line 260*f* through the facestock layer 220. The die cut line 260*f* may separate section F between a matrix portion 270*f* and a facestock portion 280*f* wherein the matrix portion 270*f* may be removed from the liner sheet 240 and the facestock portion 280*f*. Section G includes at least one die cut line 260*g* through the facestock layer 220. The die cut line 260*g* may separate section G between a matrix portion 270*g* and a facestock portion 280*g* wherein the matrix portion 270*g* may be removed from the liner sheet 240 and the facestock portion 280*g*. Section H includes at least one die cut line 260*h* through the facestock layer 220. The die cut line 260*h* may separate section F between a matrix portion 270*h* and a facestock portion 280*h* wherein the matrix portion 270*h* may be removed from the liner sheet 240 and the facestock portion 280*h*.

The sheet assembly 200 may also include a first and second die cut line 242, 244 through the liner sheet 240. The first die cut line 242 and the second die cut line 244 may be generally parallel to one another to define a strip portion 246 of the liner sheet 240. The strip portion 246 may extend under die cut lines 260*c*, 260*e*, and 260*g* as well as through perforated lines 204 and 206 as illustrated by FIG. 3. The sheet assembly 200 may also include a third and fourth die cut line 252, 254 through the liner sheet 240. The third die cut line 252 and the fourth die cut line 254 may be generally parallel to one another to define a strip portion 256 of the liner sheet 240. The strip portion 256 may extend under die cut lines 260*d*, 260*f*, and 260*h* as well as through perforated lines 204 and 206 as illustrated by FIG. 3.

In one embodiment, strip portion 246 may be positioned at an approximate midpoint position under sections C, E, and G such that, when the strip portion 246 is removed, it generally define two symmetric sized sides of facestock portions 280*c*, 280*e*, and 280*g*. Additionally, strip portion 256 may be positioned at an approximate midpoint position under sections C, E, and G such that, when the strip portion 256 is removed, it generally define two symmetric sized sides of facestock portions 280*c*, 280*e*, and 280*g*. Alternatively, the strip portions 246 and 256 may be located at various positions along the liner sheet 240.

The strip portion 246 may include a first dimension L that defines a length wherein the first dimension L is between approximately 0.1 inch to 0.15 inch and is more particularly about 0.125 inch. The first and second die cut lines 242, 244 may extend from the first edge 212 to the second edge 214 of the sheet assembly 200. In this embodiment, the die cut lines 242, 244 define the strip portion 246 having a second dimension W wherein the second dimension W is the distance between the first edge 212 and the second edge 214 of the sheet assembly 200. Additionally, the space between the third edge 216 and the fourth edge 218 may be defined by a third dimension Lt. The third dimension Lt represents the total length of the sheet assembly 200 as the second dimension W represents the transverse length of the total sheet assembly 200.

In one embodiment, the second dimension W may be between approximately 7 inches and 18 inches, or more narrowly between approximately 11 inches and 14 inches. The third dimension Lt may be between approximately 5 inches and 11 inches, or may be approximately 8.5 inches. Alternatively, the second dimension and third dimension of the sheet assembly 200 may include dimensions that compare to standard US paper sizes including letter (8.5×11 in), legal (8.5×14 in), junior legal (5×8 in), and ledger/tabloid (11×17 in) sizes or standard international paper sizes such as A, B, and C paper sizes.

In the embodiment of FIG. 3, sections C, D, E, F, G, and H may be formed by the perforation lines 202, 204, and 206 wherein the sections may have a generally equal size. In one example, section C includes facestock portion 280*c* that includes length portion Lc and width portion Wc. In one embodiment, the length portion Lc may be approximately 0.125 inch less than ½ the third dimension Lt such that the difference in dimension is generally defined by the matrix portions 270*c* and 270*d*. In one embodiment, length portion Lc may be approximately 4.125 inches. The width portion We may be approximately 0.2 inch less than ⅓ of the second dimension W. In one embodiment, width portion We may be approximately 3.46 inches. Alternatively, the length portion Lc and width portion We of the facestock portion 280*c* may be generally equal to ½ the third length Lt and ⅓ of the second length W such that the facestock portion 280*c* is generally the entire section C.

FIG. 4 illustrates another embodiment of the instant disclosure wherein a sheet assembly 300 may include a facestock layer 320 with an adhesive layer 330 and liner sheet 340. The sheet assembly 300 may be defined by a first edge 312, a second edge 314, a third edge 316 and a fourth edge 318 that may define a perimeter of the sheet assembly 300. The sheet assembly 300 may include a plurality of sections I, J, K, L, M, N, O, P, Q, and R that are separated by a plurality of perforation lines 302, 304, 306, 308, and 309. Perforation line 302 may extend from the first edge 312 to the opposite second edge 314. Perforation lines 304, 306, 308, and 309 may extend from the third edge 316 to the fourth edge 318 such that perforation lines 304, 306, 308, and 309 are generally parallel to one another.

Section I, J, K, L, M, N, O, P, Q, and R of sheet assembly 300 include similar features to sheet assembly 200 as described above. Each section of sheet assembly 300 may includes at least one die cut line 360 through the facestock layer 320. The die cut line 360 may separate the sections between a matrix portion 370 and a facestock portion 380 wherein the matrix portion 370 may be removed from the liner sheet 340 and the facestock portion 380.

The sheet assembly 300 may also include a first and second die cut lines 342, 344 through the liner sheet 340. The first die cut line 342 and the second die cut line 344 may be generally parallel to one another to define a strip portion 346 of the liner sheet 340. The strip portion 346 may extend under a plurality of die cut lines 360 of sections I, K, M, O, and Q as well as through perforated lines 304, 306, 308, and 309 as illustrated by FIG. 4. The sheet assembly 300 may also include a third and fourth die cut line 352, 354 through the liner sheet 340. The third die cut line 352 and the fourth die cut line 354 may be generally parallel to one another to define a strip portion 356 of the liner sheet 340. The strip portion 356 may extend under a plurality of die cut lines 360 of sections J, L, N, P, and R as well as through perforated lines 304, 306, 308, and 309 as illustrated by FIG. 4.

In one embodiment, strip portion 346 may be positioned at an approximate midpoint position under sections I, K, M, O, and Q such that, when the strip portion 346 is removed, it generally defines two symmetric sized sides of facestock portions 380 of sections I, K, M, O, and Q. Additionally, strip portion 356 may be positioned at an approximate midpoint position under sections J, L, N, P, and R such that, when the strip portion 356 is removed, it generally defines two symmetric sized sides of facestock portions 380 of sections J, L, N, P, and R. Alternatively, the strip portions 346 and 356 may be located at various positions along the liner sheet 340.

The strip portion 346 may include a first dimension L that defines a length wherein the first dimension L is between approximately 0.1 inch to 0.15 inch and is more particularly about 0.125 inch. The first and second die cut lines 342, 344 may extend from the first edge 312 to the second edge 314 of the sheet assembly 300. In this embodiment, the die cut lines 342, 344 define the strip portion 346 having a second dimension W wherein the second dimension W is the distance between the first edge 312 and the second edge 314 of the sheet assembly 300. Additionally, the space between the third edge 316 and the fourth edge 318 may be defined by a third dimension Lt. The third dimension Lt represents the total length of the sheet assembly 300 as the second dimension W represents the transverse length of the total sheet assembly 300.

In one embodiment, the second dimension W may be between approximately 7 inches and 18 inches, or more narrowly between approximately 11 inches and 14 inches. The third dimension Lt may be between approximately 5 inches and 11 inches, or may be approximately 8.5 inches. Alternately, the second dimension and third dimension of the sheet assembly 200 may include dimensions that compare to standard US paper sizes including letter (8.5×11 in), legal (8.5×14 in), junior legal (5×8 in), and ledger/tabloid (11×17 in) sizes or standard international paper sizes such as A, B, and C paper sizes.

In the embodiment of FIG. 4, sections I, J, K, L, M, N, O, P, Q, and R may be formed by the perforation lines 302, 304, 306, 308, and 309 wherein the sections may have a generally equal size. In one example, section I includes facestock portion 380 that includes length portion Li and width portion Wi. In one embodiment, the length portion Li may be approximately 0.375 inch less than ½ the third dimension Lt such that the difference in dimension is generally defined by the matrix portions 370. In one embodiment, length portion Li may be approximately 3.875 inches. The width portion Wi may be approximately 0.35 inch less than ⅕ of the second dimension W. In one embodiment, width portion Wi may be approximately 1.85 inches. Alternatively, the length portion Li and width portion Wi of the facestock portion 380 may be generally equal to ½ the third length Lt and ⅕ of the second length W, respectively, such that the facestock portions 380 may be generally the entire section I.

FIGS. 5-11 illustrate the method of utilizing sheet assembly 10 to laminate a sheet member SM to a substrate SUB. The sheet member SM may be any size or material that may include various indicia or colors and is to be viewed through the facestock layer 20. The substrate SUB may be any surface such as a mail envelope, poster, or structure that is intended to support the sheet member SM thereon. This disclosure is not limiting as to the size or material of either sheet member SM or substrate SUB. In this embodiment, the sheet assembly 10 of FIGS. 5-11 is illustrated without a matrix portion. In one embodiment, the sheet assembly 10 may be configured to be adhered to a substrate SUB without a sheet member SM. As such, the substrate SUB may be an electrical display such as on a laptop, cellphone, television, other type of mobile device or even a window.

Figure 5:
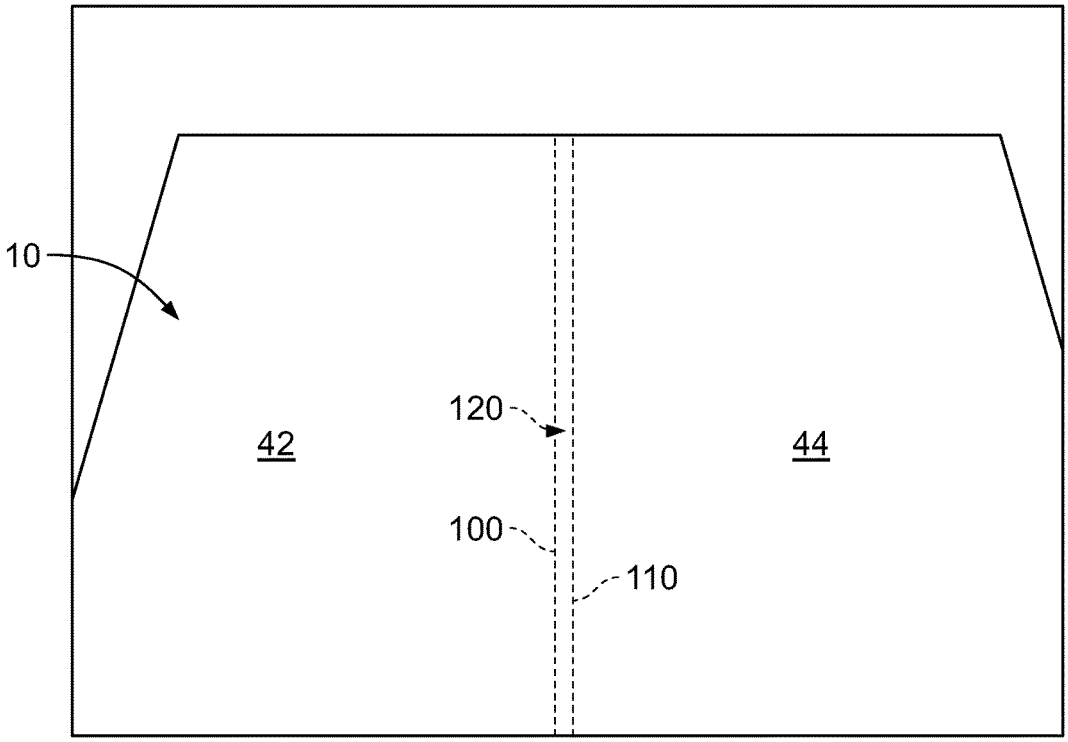
FIG. 5 is perspective view of a method of applying a facestock layer of a sheet assembly to a substrate in accordance with the present disclosure.
Figure 6:
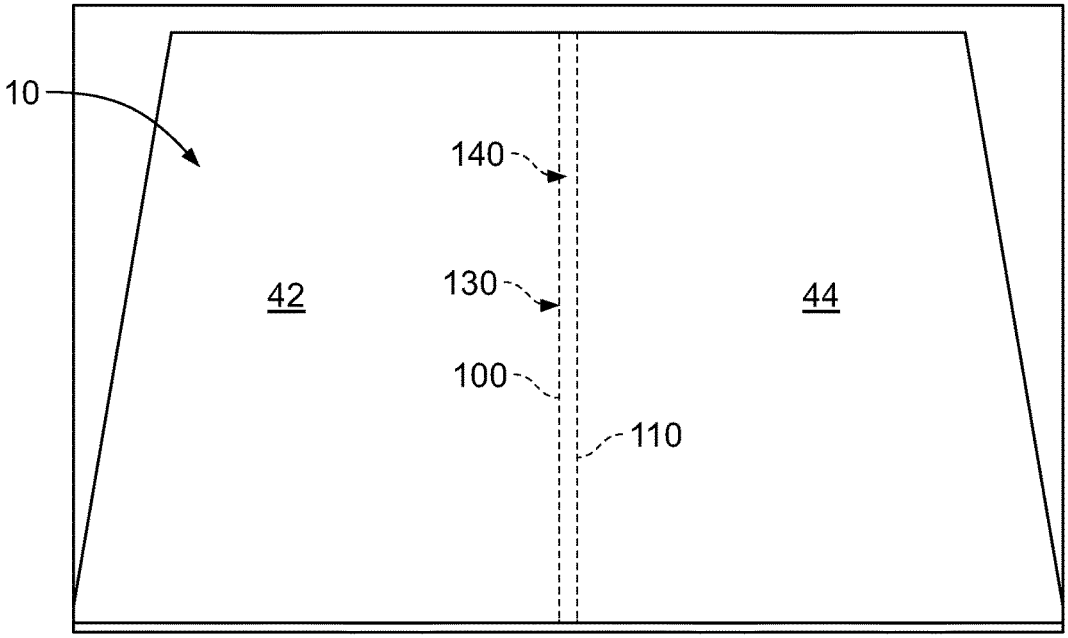
FIG. 6 is perspective view of a method of applying a facestock layer of a sheet assembly to a substrate in accordance with the present disclosure.

Initially, a desired section of sheet assembly 10 of FIGS. 1 and 2 is detached from the other section along perforation line 50. FIG. 5 illustrates one embodiment of the sheet assembly 10 wherein the liner sheet 40 facing upwardly and the strip portion 120 divides the liner sheet 40 into a first liner portion 42 and a second liner portion 44. The strip portion 120 is removed from sheet assembly 10 and leaves a void space 130 as illustrated by FIGS. 1 and 6. The void space 130 includes a depth dimension t that includes a length dimension L and a width dimension w as illustrated by FIG. 1. The depth dimension t may be approximately equal to a height of the liner sheet 40. The void space 130 allows a strip of adhesive 30 to be exposed between cut lines 100 and 110 of the liner sheet 40 such that a facestock bridge portion 140 is aligned with the void space 130.

Figure 7:
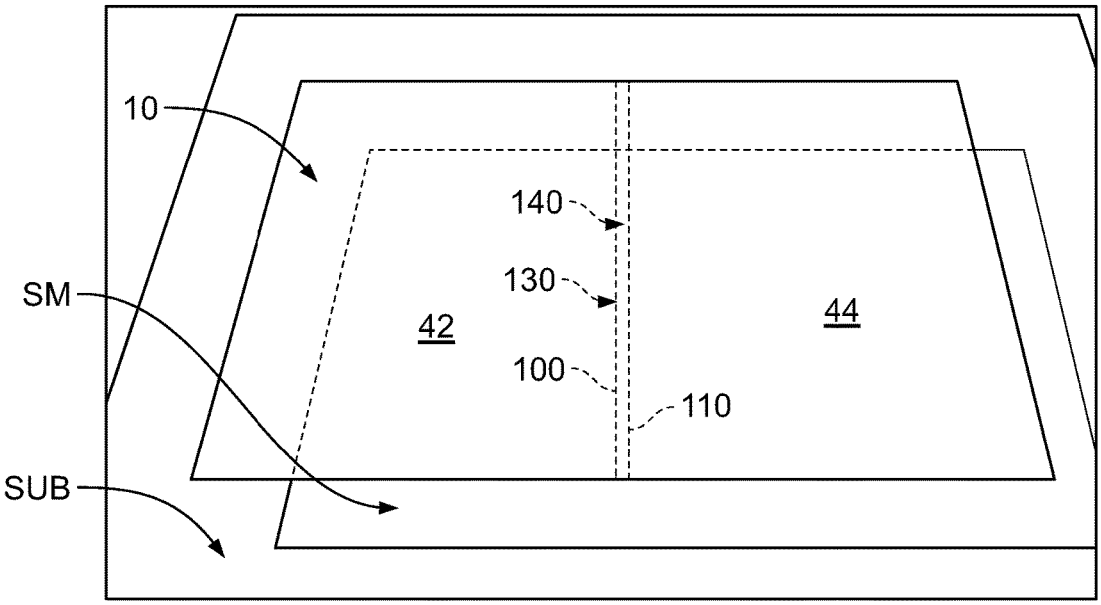
FIG. 7 is perspective view of aligning the facestock layer of a sheet assembly with the substrate in accordance with the present disclosure.
Figure 8:
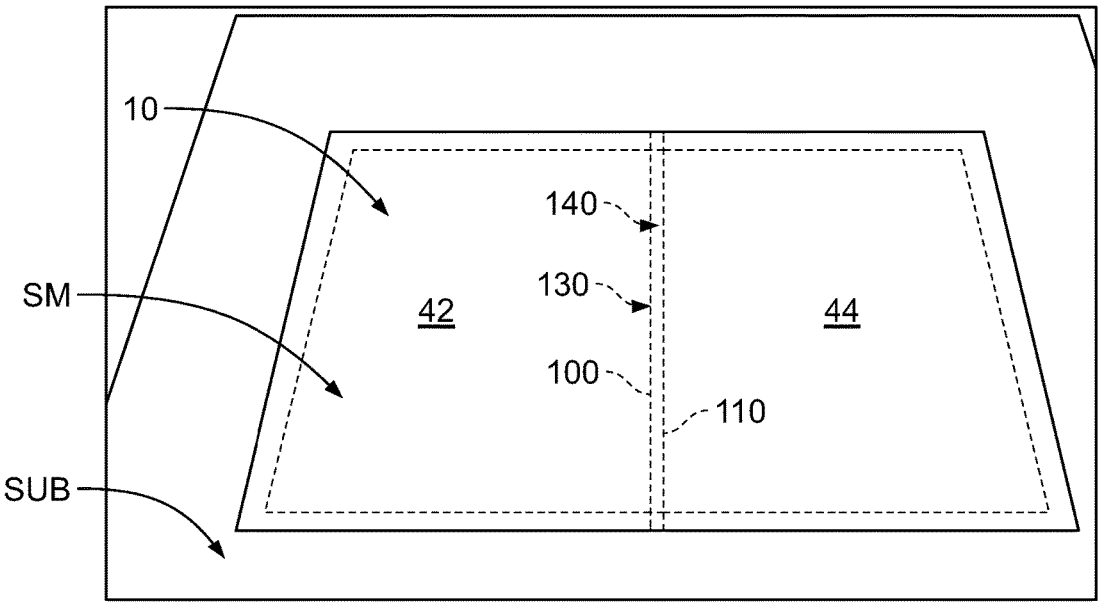
FIG. 8 is perspective view of anchoring the facestock layer of the sheet assembly with the substrate in accordance with the present disclosure.

FIG. 7 illustrates the sheet assembly 10 without strip portion 120 as it is positioned against the sheet member SM along the substrate SUB with the exposed strip of adhesive facing down. In this embodiment, the sheet assembly 10 is a size that may be generally larger than the size of the sheet member SM such that the adhesive layer 30 may be adhered to both the sheet member SM and the substrate SUB once it is properly applied thereon. The void space 130 may be placed in its desired position with the sheet member SM along the substrate SUB as illustrated by FIG. 8. Because length dimension L is small enough, the facestock bridge portion 140 of the facestock sheet 20 will not deflect enough to allow the exposed adhesive 30 to adhere to the sheet member SM. This configuration facilitates easy positioning of the sheet assembly 10. Once the sheet assembly 10 is properly placed with the sheet member SM and the substrate SUB, a user may press against the facestock bridge portion 140 of the facestock sheet 20 to adhere the exposed portion of adhesive layer 30 between cut lines 100 and 110 against at least one of the sheet member SM and the substrate SB. The adhesion of the facestock bridge portion 140 to the sheet member SM or the substrate SUB may anchor the sheet assembly 10 thereon to allow the user to peal away the first liner portion 42 and the second liner portion 44 to properly place the adhesive layer 30 against the sheet member SM and the substrate SUB in aligned orientation.

Figure 9:
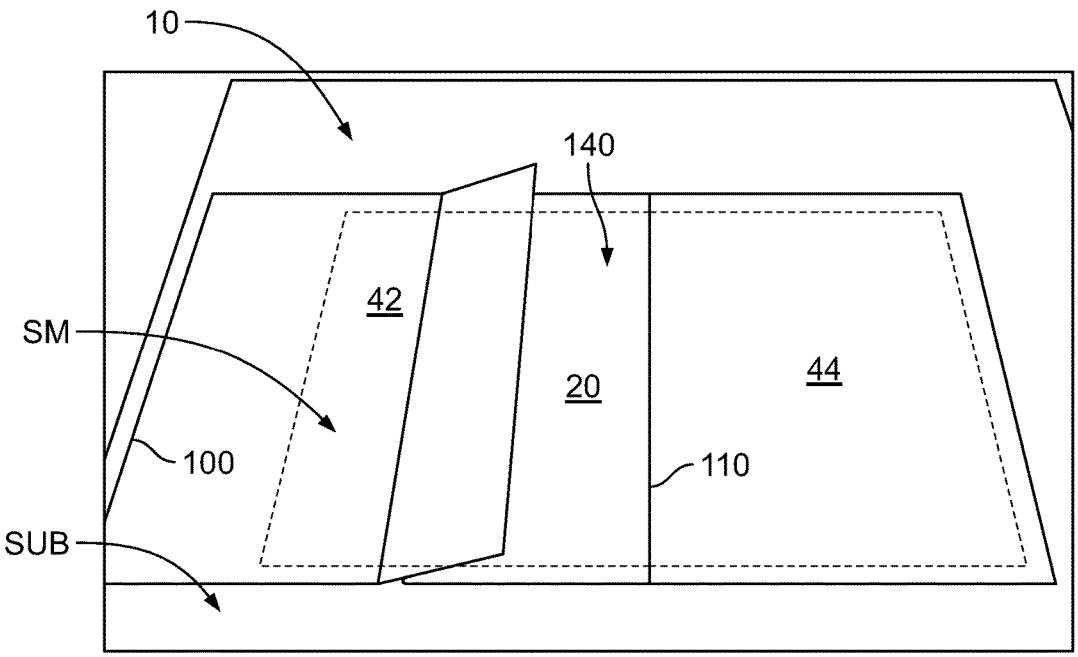
FIG. 9 is perspective view of removing a first portion of a liner sheet of the sheet assembly in accordance with the present disclosure.

FIG. 9 illustrates the facestock bridge portion 140 may be anchored to the sheet member SM with the first liner portion 42 pealed away from the facestock layer 40 thereby exposing the adhesion layer 30 to the sheet member SM and substrate SUB. In this embodiment, the user peals away the first liner portion 42 from the cut line 100 while pressing against the facestock layer 20 to abut the adhesive layer 30 against the sheet member SM and substrate SUB in a manner that minimizes bubbles and wrinkles of the facestock layer 20 as it is being manually applied by the user. Here, the first liner portion 42 is peeled away from facestock bridge portion 140 as the user grasps along cut line 100 to peel the first liner portion 42 away from the facestock layer 40.

Figure 10:
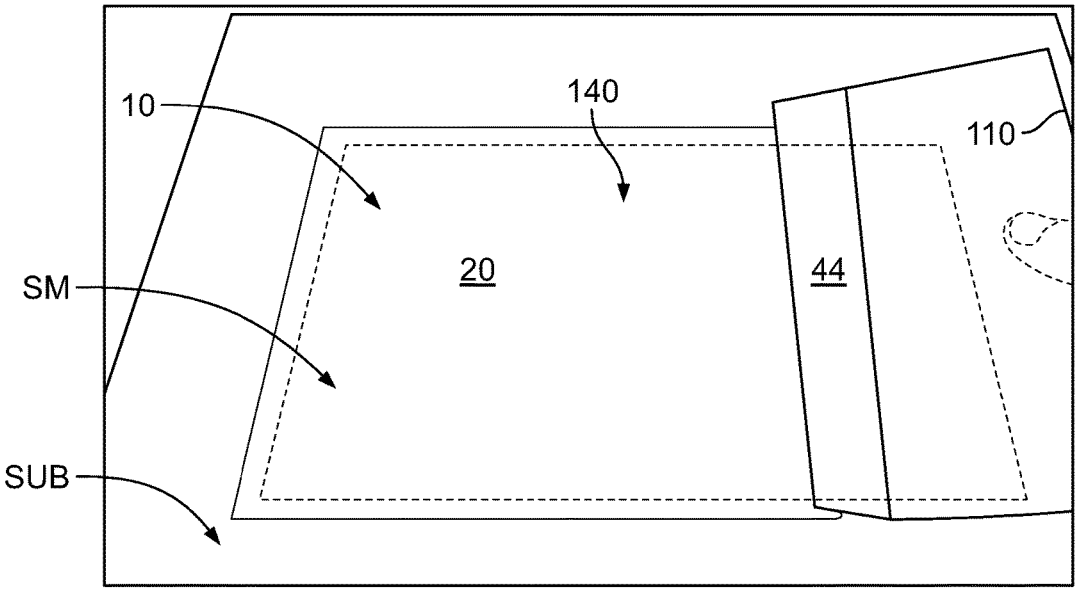
FIG. 10 is perspective view of removing a second portion of the liner sheet of the sheet assembly in accordance with the present disclosure.

FIG. 10 illustrates the facestock bridge portion 140 anchored to the sheet member SM with the second liner portion 44 pealed away from the facestock layer 40 thereby exposing the adhesive layer 30 to the sheet member SM and substrate SUB. In this embodiment, the user peals away the second liner portion 44 from the cut line 110 while pressing against the facestock layer 20 to abut the adhesive layer against the sheet member SM and substrate SUB in a manner that minimizes bubbles and wrinkles of the facestock layer 20 it is being manually applied by the user. Here, the second liner portion 44 is peeled away from facestock bridge portion 140 as the user grasps along cut line 110 to peel the second liner portion 44 away from the facestock layer 40.

Figure 11:
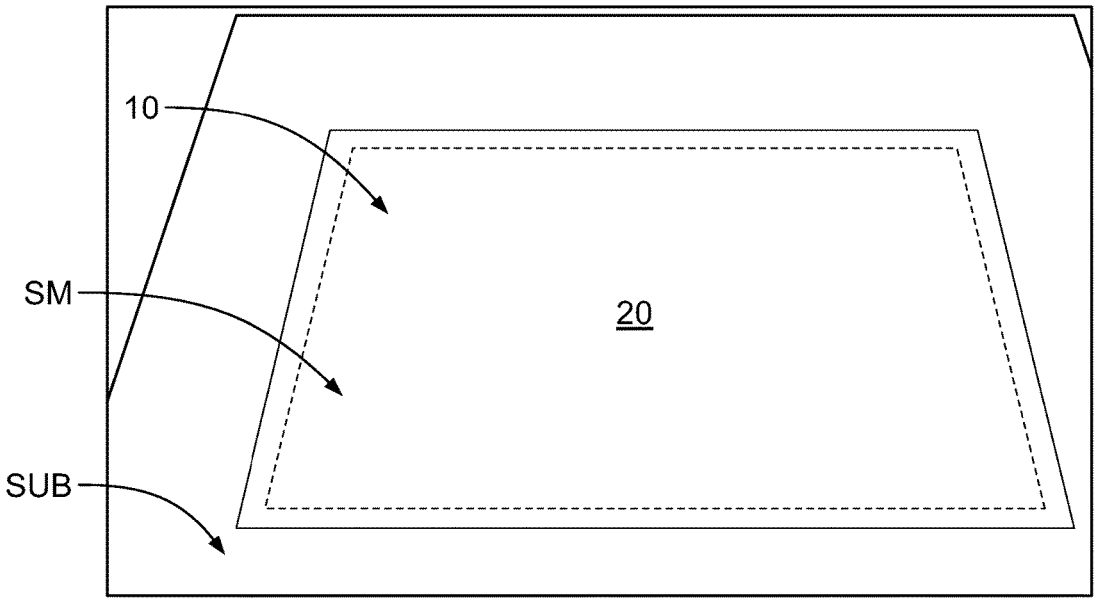
FIG. 11 is a perspective view of the facestock layer applied to the substrate in accordance with the present disclosure.

FIG. 11 illustrates the facestock layer 20 that is adhered to the sheet member SM and the substrate SUB in a manner that is aligned as desired and is void of bubbles and wrinkles.

Tables 1, 2, and 3 are provided below to disclose how the relative dimensions of the sheet assembly 10 including the configuration of the liner sheet 40, adhesive layer 30 and facestock layer 20 may utilize the facestock bridge portion 140 of various sizes relative to the sizes of the liner sheet 40 to properly anchor and apply the facestock layer 20 to a substrate.

Table 1 lists results of utilizing a sheet assembly having a facestock material 20 made of PET having a thickness of either 0.001 in or 0.002 in. The liner sheet 40 is made of paper glassined with a thickness of 0.0023 in in several examples and paper having 0.0042 in thickness with the remaining examples. In these examples, the facestock material included a modulus of elasticity of approximately 500 kg/mm2 having a density of 1.39 g/cm3. The "gap" listed is the dimension of the first length L as illustrated by FIG. 1. The listed results describe the behavior of the sheet assembly having a facestock bridge portion 140 of a given length that is anchored to a substrate. As illustrated, the result of each sheet assembly is related to the gap length relative to the liner thickness to achieve a sheet assembly that can be aligned as desired and anchored when pressed.

Table 2 lists results of a theoretical maximum dimension L along with correlated borderline and optimal maximum dimension L for the gap or facestock bridge portion as desired for sheet assemblies of various materials. The theoretical maximum dimension L is the dimension beyond which the weight of the facestock in the bridge portion would cause it to deflect and make contact with the sheet member SM or substrate SUB. Described is a sheet assembly having a facestock material 20 made of PET having various thicknesses including 0.001 in., 0.002 in, and 0.0005 in. The liner sheet 40 is made of paper glassined with various thicknesses including 0.0023 in, 0.00115 in, 0.0046 in. and 0.0042 in. In these examples, the facestock material included a modulus of elasticity of approximately 500 kg/mm2 having a density of 1.39 g/cm3. The "theoretical gap" listed is the dimension of the first length L as illustrated by FIG. 1. The listed results where calculated by the following equations:

Eq. 1 and Eq. 2 are for a simply supported bridge portion under a distributed load:

$$d=(5*(L\hat{}3)*F)/(384*E*I) \quad \text{Eq. 1:}$$

$$I=(wh\hat{}3)/12 \quad \text{Eq. 2:}$$

Combining Eq.1 and Eq.2 and solving for the theoretical maximum dimension $L_{max}$, the gap:

$$L_{max}=(6.4*(h\hat{}2)*E*d/r)\hat{}0.25 \quad \text{Eq. 3:}$$

Where: d=deflection at center (set to liner thickness for the calculations), $L_{max}$=bridge length (or gap), F=load (weight of beam calculated from its density and volume), E=tensile modulus, I=area moment of inertia, w=width of rectangular shaped bridge portion, h=height of rectangular shaped bridge portion, r=density.

TABLE 1

Laminease Test Results

| Face Material | Liner Material | Face Caliper (in) | Liner Caliper (in) | Modulus (kg/mm2) | Density (g/cm3) | Gap | Result |
|---|---|---|---|---|---|---|---|
| PET | paper glassined | 0.001 | 0.0023 | 500 | 1.39 | 1 | stuck immediately |
| PET | paper glassined | 0.001 | 0.0023 | 500 | 1.39 | 0.5 | stuck immediately |
| PET | paper glassined | 0.001 | 0.0023 | 500 | 1.39 | 0.5 | stuck immediately |
| PET | paper glassined | 0.001 | 0.0023 | 500 | 1.39 | 0.5 | stuck almost immediately |
| PET | paper glassined | 0.001 | 0.0023 | 500 | 1.39 | 0.4375 | borderline, sometimes stuck, sometimes did not |
| PET | paper glassined | 0.001 | 0.0023 | 500 | 1.39 | 0.375 | borderline, sometimes stuck, sometimes did not |
| PET | paper glassined | 0.001 | 0.0023 | 500 | 1.39 | 0.375 | borderline, sometimes stuck, sometimes did not |
| PET | paper glassined | 0.001 | 0.0023 | 500 | 1.39 | 0.25 | borderline, less sticking but sometimes stuck |
| PET | paper glassined | 0.001 | 0.0023 | 500 | 1.39 | 0.25 | borderline, less sticking but sometimes stuck |
| PET | paper glassined | 0.001 | 0.0023 | 500 | 1.39 | 0.1875 | borderline, sometimes sticks when curled or lifted one side |
| PET | paper glassined | 0.001 | 0.0023 | 500 | 1.39 | 0.125 | no sticking and adheres when pressed |
| PET | paper glassined | 0.001 | 0.0023 | 500 | 1.39 | 0.0625 | no sticking and adheres when pressed |
| PET | paper glassined | 0.001 | 0.0023 | 500 | 1.39 | 0.046875 | have to press a little harder to get it to adhere |
| PET | paper glassined | 0.001 | 0.0023 | 500 | 1.39 | 0.032 | have to press hard to get it to adhere; more difficult to remove strip |
| PET | paper | 0.002 | 0.0042 | 500 | 1.39 | 1.5 | stuck almost immediately |
| PET | paper | 0.002 | 0.0042 | 500 | 1.39 | 1.25 | borderline, high tendency to stick if not handled carefully |
| PET | paper | 0.002 | 0.0042 | 500 | 1.39 | 1 | borderline, can stick if not handled carefully |
| PET | paper | 0.002 | 0.0042 | 500 | 1.39 | 0.7 | borderline, can stick if not handled carefully |
| PET | paper | 0.002 | 0.0042 | 500 | 1.39 | 0.4 | borderline, can stick if curled or lifted on one side |
| PET | paper | 0.002 | 0.0042 | 500 | 1.39 | 0.2 | no sticking and adheres when pressed |
| PET | paper | 0.002 | 0.0042 | 500 | 1.39 | 0.0625 | have to press hard to get it to adhere |

TABLE 2

Maximum Gap or Strip Width Calculation

| Face Material | Face Caliper (in) | Face Modulus (kg/mm2) | Face Density (g/cm3) | Liner Material | Liner Caliper (in) | Deflection % of Liner Caliper | Theoretical Gap* (in) | Correlation to Results - borderline** | Correlation to Results - optimal** |
|---|---|---|---|---|---|---|---|---|---|
| PET | 0.001 | 500 | 1.39 | glassine paper | 0.0023 | 100 | 0.676 | 0.437 | 0.125 |
| PET | 0.001 | 500 | 1.39 | glassine paper | 0.00115 | 100 | 0.568 | 0.368 | 0.105 |
| PET | 0.001 | 500 | 1.39 | glassine paper | 0.0046 | 100 | 0.804 | 0.520 | 0.149 |
| PET | 0.002 | 500 | 1.39 | glassine paper | 0.0023 | 100 | 0.956 | 0.618 | 0.177 |
| PET | 0.0005 | 500 | 1.39 | glassine paper | 0.0023 | 100 | 0.478 | 0.309 | 0.088 |
| | | | | | | | #DIV/0! | #DIV/0! | #DIV/0! |
| | | | | | | | #DIV/0! | #DIV/0! | #DIV/0! |
| PVC | 0.001 | 240 | 1.33 | glassine paper | 0.0023 | 100 | 0.569 | 0.368 | 0.105 |
| BOPP | 0.001 | 278 | 0.9 | glassine paper | 0.0023 | 100 | 0.650 | 0.421 | 0.120 |
| CPP | 0.001 | 72 | 0.9 | glassine paper | 0.0023 | 100 | 0.464 | 0.300 | 0.086 |
| PET | 0.002 | 500 | 1.39 | paper | 0.0042 | 100 | 1.111 | 0.719 | 0.205 |
| | | | | | | | #DIV/0! | #DIV/0! | #DIV/0! |
| | | | | | | | #DIV/0! | #DIV/0! | #DIV/0! |

*Calculated based on the equations Eq. 1, Eq. 2 and Eq. 3.

**Calculated correlations based on evaluation of actual behavior of 0.001" thick PET facestock with adhesive and 0.0023" thick paper liner applied to a paper surface.

Similarly, Table 3 below describes the theoretical minimum dimension L for the gap or facestock bridge portion as desired for sheet assemblies of various materials. The theoretical minimum dimension L is the dimension below which too large of a force would need to be applied by the user to get the facestock in the bridge portion to deflect enough to make contact with the sheet member SM or substrate SUB. Described is a sheet assembly having a facestock material 20 made of PET having various thicknesses including 0.001 in. and 0.002 in. The liner sheet 40 is made of paper glassine with a thickness including 0.0023 in. and paper with a thickness including 0.0042 in. In these examples, the facestock material included a modulus of elasticity of approximately 500 kg/mm2 having a density of 1.39 g/cm3. The "theoretical minimum gap" listed is the dimension of the first length L as illustrated by FIG. 1. The listed results where calculated by utilizing equations Eq. 1 and Eq. 2 above as well as assuming that a pressure of about 4.5 kg/in2 is the most pressure applied by the user's finger to the bridge portion to apply the exposed adhesive layer against the substrate.

Combining Eq.1 and Eq.2 and solving for the theoretical minimum dimension $L_{min}$, the gap:

$$L_{min}=(12.03*d*E*w*h\hat{}3)\hat{}0.25 \quad \text{Eq.4:}$$

Where: the units of 12.03 are cm2/kg. Additionally, the effective "w" dimension of the area pressed by the user's finger is estimated to be about 0.3 in.

TABLE 3

| Face Material | Face Caliper (in) | Face Modulus (kg/mm2) | Liner Material | Liner Caliper (in) | Theoretical Min Gap (in) |
|---|---|---|---|---|---|
| PET | 0.001 | 500 | glassine paper | 0.0023 | 0.03202169 |
| PET | 0.002 | 500 | paper | 0.0042 | 0.06260329 |

Although the embodiments of the present invention have been illustrated in the accompanying drawings and described in the foregoing detailed description, it is to be understood that the present invention is not to be limited to just the embodiments disclosed, but that the invention described herein is capable of numerous rearrangements, modifications and substitutions without departing from the scope of the claims hereafter. The features of each embodiment described and shown herein may be combined with the features of the other embodiments described herein. The claims as follows are intended to include all modifications and alterations insofar as they come within the scope of the claims or the equivalent thereof.

Having thus described the invention, I claim:

1. A sheet assembly for applying a facestock layer to a substrate comprising:

a facestock layer having a length that is parallel to a first edge of the facestock layer and at least one facestock bridge portion defining two separate facestock portions on each of the facestock bridge portion, the at least one facestock bridge portion intersecting the first edge and oriented at an angle relative to the length;

an adhesive layer;

a liner sheet including a removable strip portion having a first dimension and exposing a portion of the adhesive layer under the facestock bridge portion when the strip portion is removed;

wherein the facestock bridge portion anchors the sheet assembly to a substrate and will not adhere to the substrate unless pushed by a user, wherein the first dimension is between 0.291% and 8.75% of the length of the facestock, and wherein the two separate facestock portions and the facestock bridge portion adhere to the substrate as a single entity when the strip portion is anchored and the liner sheet is removed.

2. The sheet assembly according to claim 1, wherein the facestock layer is made of a generally see-through material.

3. The sheet assembly according to claim 1, further comprising at least one perforation line that divides the sheet assembly into multiple sections.

4. The sheet assembly according to claim 1, wherein the sheet assembly includes at least one of two sections, four sections, and ten sections.

5. The sheet assembly according to claim 1, further comprising at least one die cut line within the facestock layer for separating a facestock portion and a matrix portion.

6. The sheet assembly according to claim 1, wherein the strip portion is positioned between a first section and a second section.

7. The sheet assembly according to claim 6, wherein the strip portion is positioned along a center portion of the facestock.

8. The sheet assembly according to claim 1, wherein the first dimension is between approximately 0.032 inch to 0.4375 inch.

9. The sheet assembly according to claim 1, wherein the first dimension is between about 0.0625 inch to 0.375 inch.

10. The sheet assembly according to claim 1, wherein the single entity has a second dimension and wherein the first dimension is between 0.776% and 10.6% of the second dimension.

11. The sheet assembly according to claim 10, wherein the second dimension is between one half and one third of the length of the facestock.

12. The sheet assembly according to claim 1, wherein the facestock layer is a label.

13. A sheet assembly for applying a facestock layer to a substrate comprising:

a facestock layer having a facestock bridge portion bisecting the sheet assembly along a line to define separate first and second facestock portions on opposite edges of the facestock bridge portion;

an adhesive layer that remains affixed to the facestock layer;

a liner sheet having a thickness and including a removable strip portion that, when removed, exposes a portion of the adhesive layer under the facestock bridge portion;

wherein the strip portion: i) has a relative width, measured orthogonally to the line, that is between 174.8 times and 493.9 times the thickness of the liner sheet, and ii) is disposed over the facestock bridge portion;

wherein the facestock bridge portion adheres to a substrate to anchor the sheet assembly to the substrate the strip portion is removed and allows the liner sheet to be removed; and wherein the facestock bridge portion and the first and second facestock portions define a single unitary item after the liner sheet is removed.

14. The sheet assembly according to claim 13, wherein the facestock bridge portion will not adhere to the substrate even after strip portion of the liner sheet is removed until sufficient force is applied to deflect the adhesive layer under the facestock bridge portion into contact with the substrate.

15. The sheet assembly according to claim 13, wherein the facestock layer is made of a generally see-through material.

16. The sheet assembly according to claim 13, wherein the facestock layer is a label.

17. The sheet assembly according to claim 13, further comprising at least one perforation line that divides the sheet assembly into multiple sections.

18. The sheet assembly according to claim 13, wherein the sheet assembly includes at least one of two sections, four sections, and ten sections.

19. The sheet assembly according to claim 13, further comprising at least one die cut line within the facestock layer for separating a sectional portion and a matrix portion.

20. The sheet assembly according to claim 13, wherein the strip portion has identical dimensions relative to the facestock bridge portion.

21. The sheet assembly according to claim 13, wherein the relative width of the strip portion, measured orthogonally to the line, that is between 13.92 times and 72.92 times the thickness of the liner sheet.

* * * * *